US009861904B2

(12) United States Patent
Hoffman

(10) Patent No.: US 9,861,904 B2
(45) Date of Patent: Jan. 9, 2018

(54) MOTORIZED TOY SYSTEM

(71) Applicant: Dustin Hoffman, Osseo, WI (US)

(72) Inventor: Dustin Hoffman, Osseo, WI (US)

( * ) Notice: Subject to any disclaimer, the term of this patent is extended or adjusted under 35 U.S.C. 154(b) by 0 days.

(21) Appl. No.: 15/049,141

(22) Filed: Feb. 21, 2016

(65) Prior Publication Data

US 2017/0239584 A1 Aug. 24, 2017

(51) Int. Cl.
*A63H 17/14* (2006.01)
*A63H 17/05* (2006.01)

(52) U.S. Cl.
CPC ..... *A63H 17/05* (2013.01); *A63H 2017/055* (2013.01)

(58) Field of Classification Search
USPC ..... 446/424, 427, 429, 431, 434, 475, 483
See application file for complete search history.

(56) References Cited

U.S. PATENT DOCUMENTS 871,823 A * 11/1907 Robinson ..... A63H 33/3044 446/424
2,564,825 A * 8/1951 Wisslead ..... A63H 17/12 414/526
2,618,376 A * 11/1952 May, Jr. ..... A63H 33/3044 198/533
2,658,602 A * 11/1953 Bonanno ..... A63H 33/3044 198/582
2,678,717 A * 5/1954 Lucas ..... A63H 33/3044 198/311
2,786,305 A 5/1954 Carter
3,810,593 A 5/1974 Krysl
4,128,964 A * 12/1978 Ogasawara ..... A63H 18/00 187/267
4,844,447 A * 7/1989 McKnight ..... A63F 7/02 273/121 B
5,306,192 A * 4/1994 Caveza ..... A63H 33/3055 426/104
5,328,015 A * 7/1994 Volk, Jr. ..... B65G 65/46 198/548
5,879,221 A 3/1999 Barton et al.
6,017,182 A * 1/2000 Grieshop ..... B60P 1/42 198/550.1
6,261,050 B1 * 7/2001 Kuhns ..... B60P 1/42 198/671
6,267,663 B1 * 7/2001 Nottingham ..... G07D 9/008 194/344
6,485,351 B2 * 11/2002 Bruder ..... A63H 17/05 446/427
6,592,427 B1 * 7/2003 Wilhelm ..... A63H 19/15 105/1.5
D484,924 S 1/2004 Schneider
7,168,554 B2 * 1/2007 Brandt ..... B60P 1/42 198/668
7,347,763 B2 3/2008 Ewringmann
(Continued)

*Primary Examiner* — Kurt Fernstrom

(57) ABSTRACT

A motorized toy system includes a toy implement that may be manipulated. The toy implement has a bin and an auger chute. The auger chute is hingedly coupled to the toy implement. The auger chute is positionable between a deployed position and a stored position. The bin may contain particles. A dispensing unit is coupled to the toy implement. The dispensing unit is operationally coupled between the bin and the auger chute. Thus, the dispensing unit may selectively urge the particles outwardly from the auger chute.

7 Claims, 5 Drawing Sheets

(56) References Cited

U.S. PATENT DOCUMENTS

| | | | | |
|---|---|---|---|---|
| 7,601,047 | B2 * | 10/2009 | Bruder | A63H 17/06 241/260.1 |
| 7,976,356 | B2 | 7/2011 | Bruder | |
| 8,827,782 | B2 * | 9/2014 | Dise | A01F 12/46 460/114 |
| 8,955,213 | B2 * | 2/2015 | Gordon | A63H 9/00 29/428 |
| 2008/0207086 | A1 | 8/2008 | Ewringmann | |

* cited by examiner

MOTORIZED TOY SYSTEM

BACKGROUND OF THE DISCLOSURE

Field of the Disclosure

The disclosure relates to toy devices and more particularly pertains to a new toy device for simulating crop harvesting.

SUMMARY OF THE DISCLOSURE

An embodiment of the disclosure meets the needs presented above by generally comprising a toy implement that may be manipulated. The toy implement has a bin and an auger chute. The auger chute is hingedly coupled to the toy implement. The auger chute is positionable between a deployed position and a stored position. The bin may contain particles. A dispensing unit is coupled to the toy implement. The dispensing unit is operationally coupled between the bin and the auger chute. Thus, the dispensing unit may selectively urge the particles outwardly from the auger chute.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
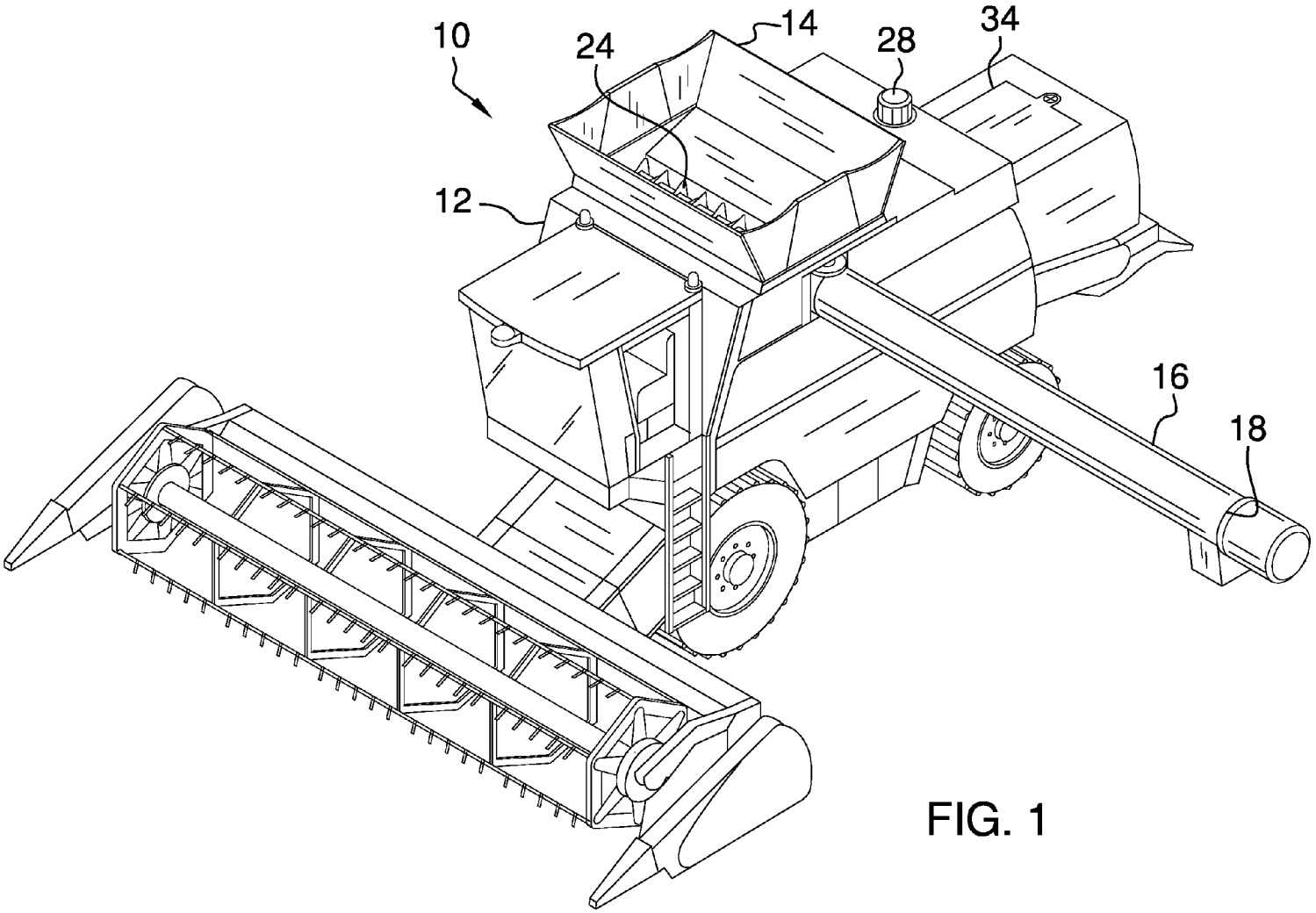
FIG. 1 is a top perspective view of a motorized toy system according to an embodiment of the disclosure.
Figure 2:
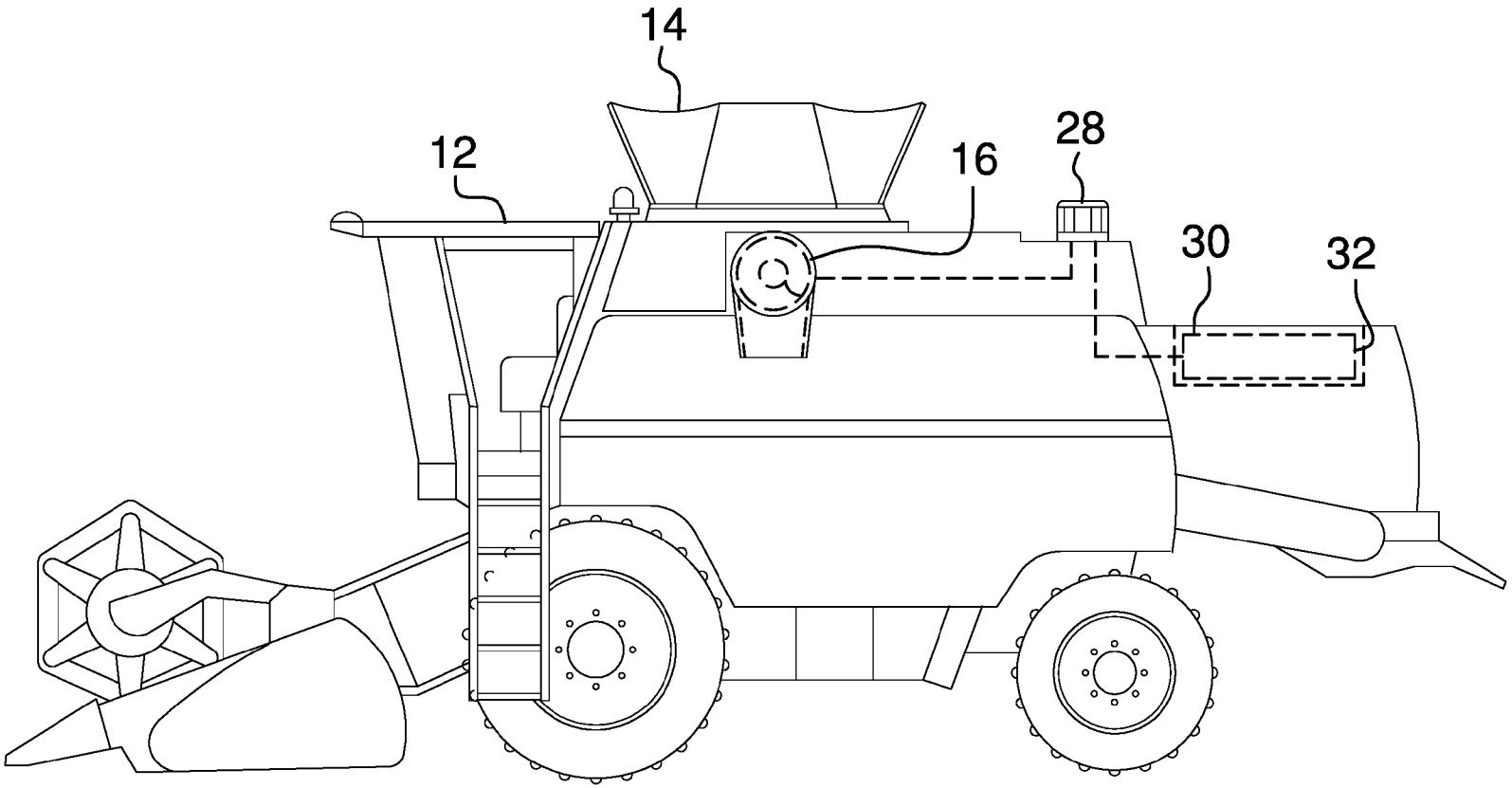
FIG. 2 is a left side view of an embodiment of the disclosure.
Figure 3:
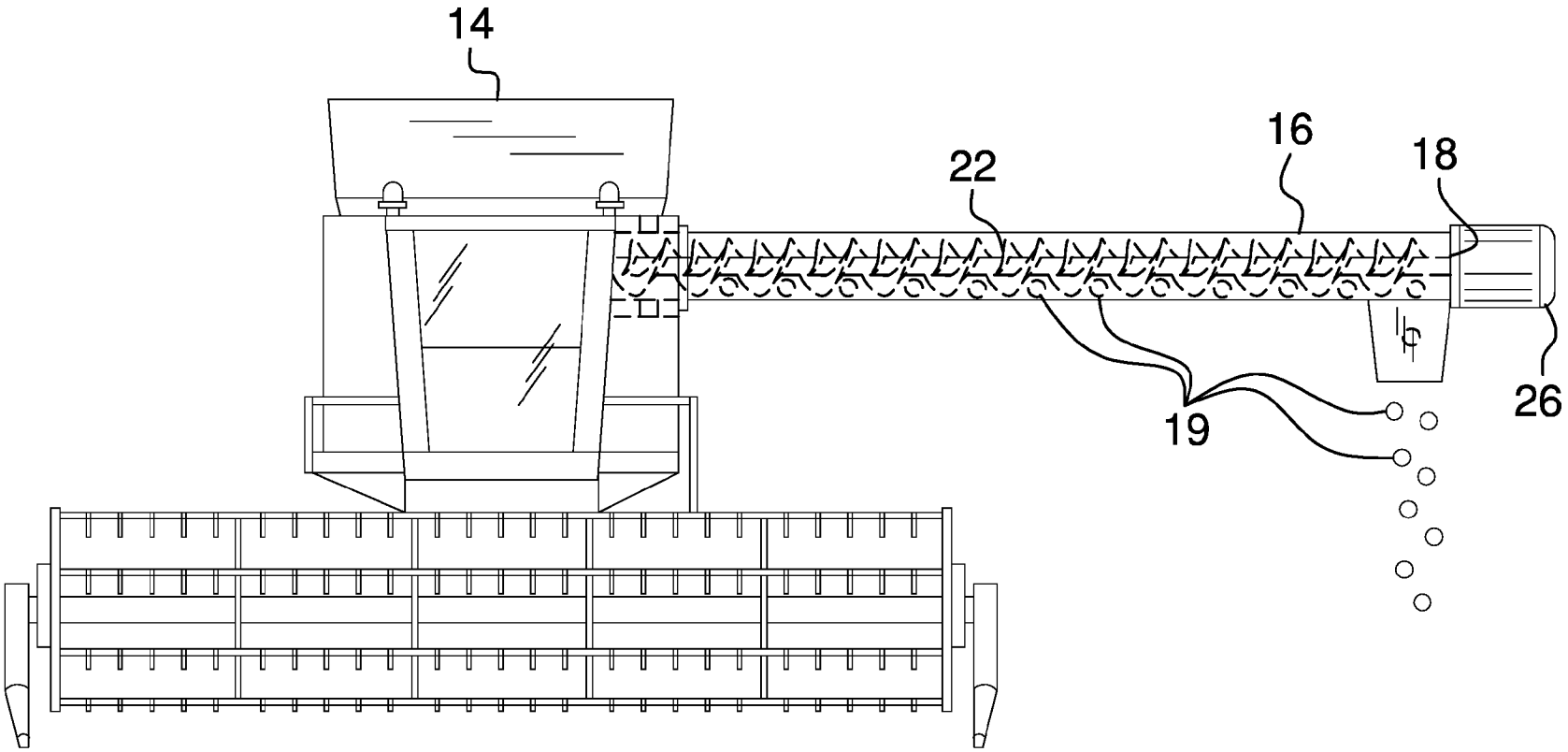
FIG. 3 is a front view of an embodiment of the disclosure.
Figure 4:
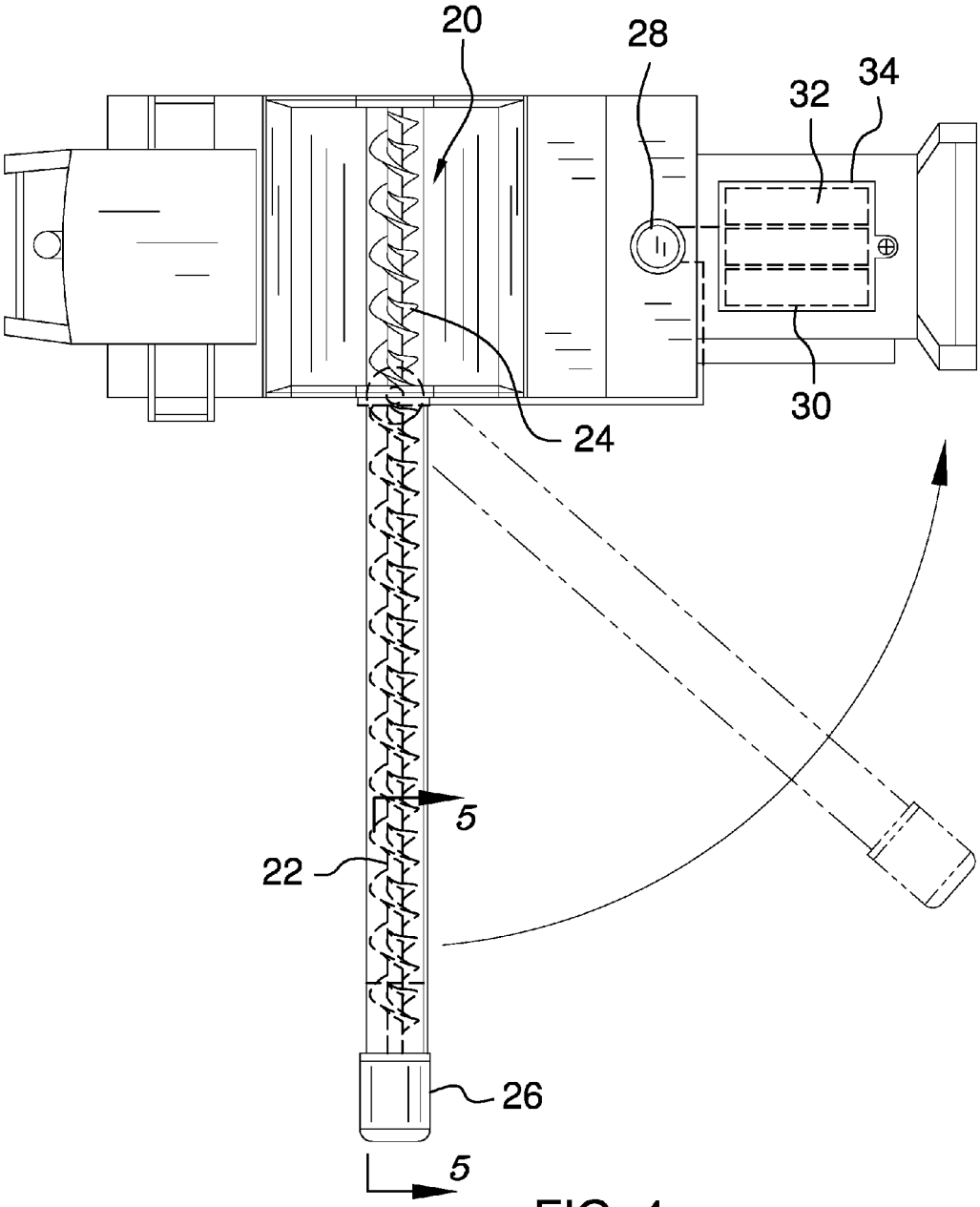
FIG. 4 is a top phantom view of an embodiment of the disclosure.
Figure 5:
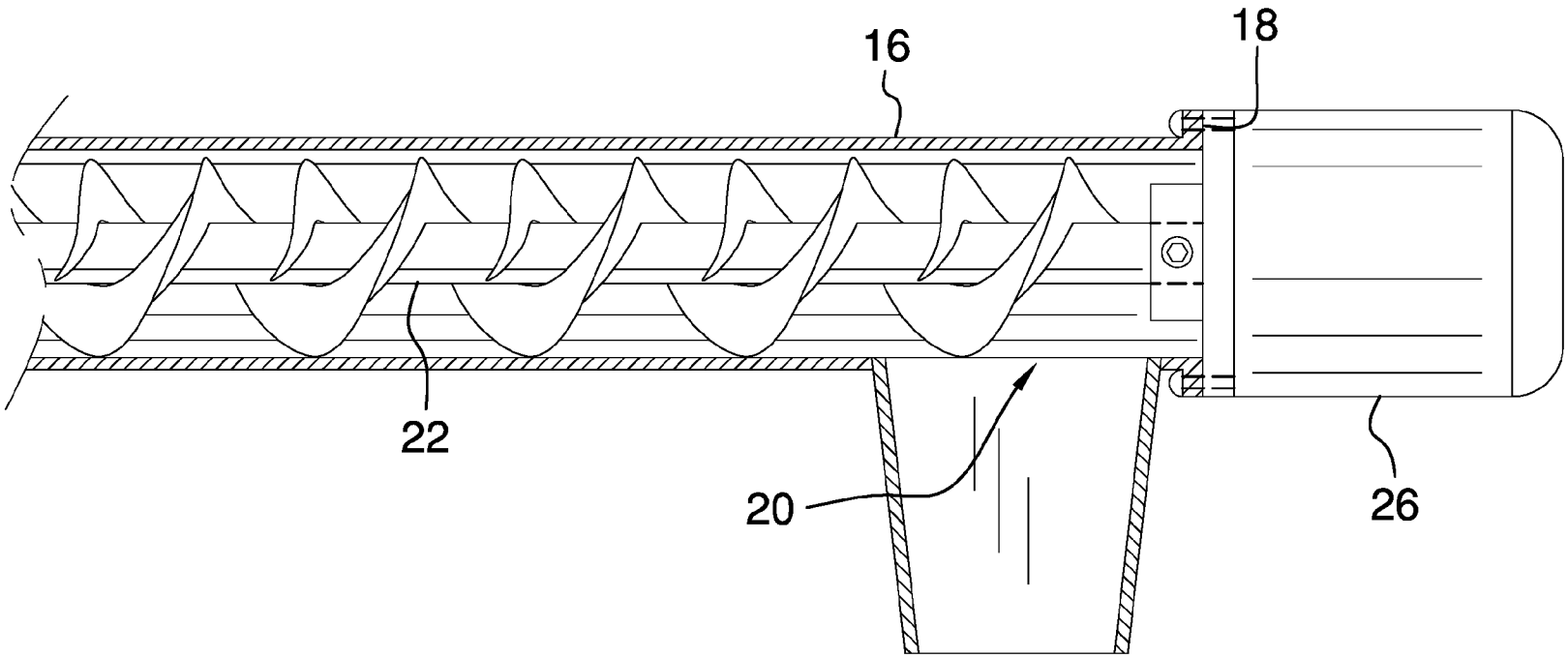
FIG. 5 is a cross sectional view taken along line 5-5 of FIG. 4 of an embodiment of the disclosure.

With reference now to the drawings, and in particular to FIGS. 1 through 5 thereof, a new toy device embodying the principles and concepts of an embodiment of the disclosure and generally designated by the reference numeral 10 will be described.

As best illustrated in FIGS. 1 through 5, the motorized toy system 10 generally comprises a toy implement 12 structured to resemble a combine harvester having a plurality of wheels. The wheels are oriented to rotate defining a linear direction for movement of the toy implement 12. The toy implement 12 may be manipulated. The toy implement 12 has a bin 14 and an auger chute 16. The auger chute 16 is hingedly coupled to the toy implement 12 such that the auger chute 16 pivots within a plane extending perpendicularly from the toy implement 12. The auger chute 16 is positionable between a deployed position extending perpendicular to the direction of movement of the toy implement 12 and a stored position extending parallel to the direction of movement of the toy implement 12. The auger chute 16 has a distal end 18 with respect to the toy implement 12. The bin 14 may contain particles 19.

A dispensing unit 20 is coupled to the toy implement 12. The dispensing unit 20 is operationally coupled between the bin 14 and the auger chute 16. Thus, the dispensing unit 20 may selectively urge the particles 19 outwardly from the auger chute 16. The particles 19 may be dried corn or the like. Thus, the toy implement 12 may simulate the process of harvesting corn or the like.

The dispensing unit 20 comprises a first auger 22 that is rotatably coupled to the auger chute 16. The first auger 22 is coextensively positioned within the auger chute 16. A second auger 24 is rotatably positioned in the bin 14. The second auger 24 is in mechanical communication with the first auger 22 when the auger chute 16 is positioned in the deployed position. The auger chute 16 may extend laterally away from the toy implement 12 when the auger chute 16 is in the deployed position.

A motor 26 is coupled to the auger chute 16 and the motor 26 is positioned on the distal end 18 of the auger chute 16. The motor 26 is mechanically coupled to the first auger 22. The motor 26 rotates the first auger 22 when the motor 26 is turned on. The first auger 22 rotates the second auger 24 when the motor 26 is turned on and the auger chute 16 is in the deployed position. Thus, the particles 19 are urged to travel outwardly from the distal end 18 of the auger chute 16 when the motor 26 is turned on.

A switch 28 is coupled to the toy implement 12 and the switch 28 may be manipulated. The switch 28 is electrically coupled to the motor 26. A power supply 30 is positioned in the toy implement 12 and the power supply 30 is electrically coupled to the switch 28. The power supply 30 comprises at least one battery 32. A battery cover 34 is removably coupled to the toy implement 12 and the power supply 30 is positioned beneath the battery cover 34.

In use, the particles 19 are placed in the bin 14. The auger chute 16 is positioned in the deployed position. The switch 28 is manipulated to turn the motor 26 on. The motor 26 rotates the first auger 22 and the second auger 24. The first auger 22 and the second auger 24 urge the particles 19 outwardly from the distal end 18 of the auger chute 16.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motorized toy system comprising:

a toy implement being structured to resemble a combine harvester having a plurality of wheels, said wheels being oriented to rotate defining a linear direction for movement of said toy implement, said toy implement being configured to be manipulated, said toy implement having a bin and an auger chute, said auger chute being hingedly coupled to said toy implement such that said auger chute pivots within a plane extending perpendicularly from said toy implement, said auger chute being positionable between a deployed position extending perpendicular to the direction of movement of said toy implement and a stored position extending parallel to the direction of movement of said toy implement, said bin being configured to contain particles; and a dispensing unit being coupled to said toy implement, said dispensing unit being operationally coupled between said bin and said auger chute wherein said dispensing unit is configured to selectively urge the particles outwardly from said auger chute.

2. The system according to claim 1, wherein said dispensing unit comprises a first auger being rotatably coupled to said auger chute, said first auger being coextensively positioned within said auger chute.

3. The system according to claim 2, further comprising a second auger being rotatably positioned in said bin, said second auger being in mechanical communication with said first auger when said auger chute is positioned in said deployed position.

4. The system according to claim 1, further comprising:

said auger chute having a distal end;

a first auger being positioned in said auger chute;

a second auger; and a motor being coupled to said auger chute, said motor being positioned on said distal end of said auger chute, said motor being mechanically coupled to said first auger, said motor rotating said first auger when said motor is turned on, said first auger rotating said second auger when said motor is turned on and said auger chute is in said deployed position.

5. The system according to claim 4, further comprising a switch being coupled to said toy implement wherein said switch is configured to be manipulated, said switch being electrically coupled to said motor.

6. The system according to claim 5, further comprising a power supply being positioned in said toy implement, said power supply being electrically coupled to said switch, said power supply comprising at least one battery.

7. A motorized toy system comprising:

a toy implement being structured to resemble a combine harvester having a plurality of wheels, said wheels being oriented to rotate defining a linear direction for movement of said toy implement, said toy implement being configured to be manipulated, said toy implement having a bin and an auger chute, said auger chute being hingedly coupled to said toy implement such that said auger chute pivots within a plane extending perpendicularly from said toy implement, said auger chute being positionable between a deployed position extending perpendicular to the direction of movement of said toy implement and a stored position extending parallel to the direction of movement of said toy implement, said bin being configured to contain particles, said auger chute having a distal end with respect to said toy implement; and a dispensing unit being coupled to said toy implement, said dispensing unit being operationally coupled between said bin and said auger chute wherein said dispensing unit is configured to selectively urge the particles outwardly from said auger chute, said dispensing unit comprising:

a first auger being rotatably coupled to said auger chute, said first auger being coextensively positioned within said auger chute, a second auger being rotatably positioned in said bin, said second auger being in mechanical communication with said first auger when said auger chute is positioned in said deployed position, a motor being coupled to said auger chute, said motor being positioned on said distal end of said auger chute, said motor being mechanically coupled to said first auger, said motor rotating said first auger when said motor is turned on, said first auger rotating said second auger when said motor is turned on and said auger chute is in said deployed position, a switch being coupled to said toy implement wherein said switch is configured to be manipulated, said switch being electrically coupled to said motor, and a power supply being positioned in said toy implement, said power supply being electrically coupled to said switch, said power supply comprising at least one battery.

* * * * *